United States Patent [19]

Russell et al.

[11] 4,071,959

[45] Feb. 7, 1978

[54] GYRO-STABILIZED SINGLE-AXIS PLATFORM

[76] Inventors: Michael King Russell, Lynworth House, Prestbury; Anthony William Russell, The Bittams, Crippetts Road, Leckhampton, both of Cheltenham, England

[21] Appl. No.: 669,518

[22] Filed: Mar. 23, 1976

[30] Foreign Application Priority Data

Mar. 26, 1975 United Kingdom ..... 12456/75

[51] Int. Cl.[2] ..... G01C 9/06; G01C 19/00

[52] U.S. Cl. ..... 33/312; 33/313; 33/318

[58] Field of Search ..... 33/304, 312, 313, 318

[56] References Cited

U.S. PATENT DOCUMENTS

| | | | |
|---|---|---|---|
| 3,771,118 | 11/1973 | Lichte et al. | 33/312 |
| 3,808,697 | 5/1974 | Hall | 33/312 |

OTHER PUBLICATIONS

Pitman; George R., *Inertial Guidance*, Wiley, 1962, pp. 53–55.

*Primary Examiner*—Steven L. Stephan
*Attorney, Agent, or Firm*—Young & Thompson

[57] ABSTRACT

An instrument for measuring the direction of a borehole in order to carry out a spatial survey thereof comprises a gyro-stabilized single-axis platform having its axis coincident with the axis of the borehole and three gravity sensors for measuring three components of gravity in the direction of the borehole axis and in two mutually perpendicular directions in a plane perpendicular to said axis.

8 Claims, 9 Drawing Figures

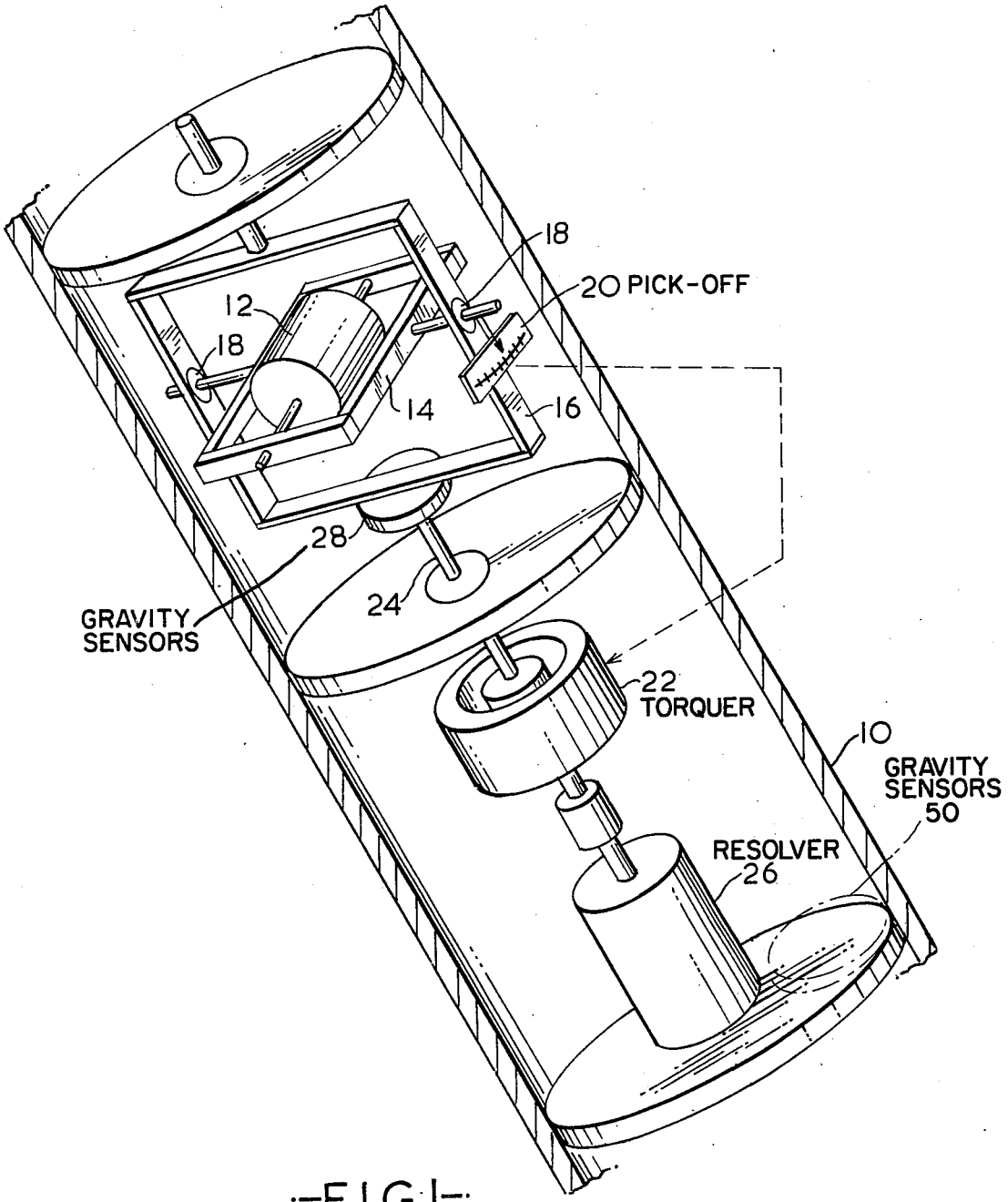
-FIG. 1-

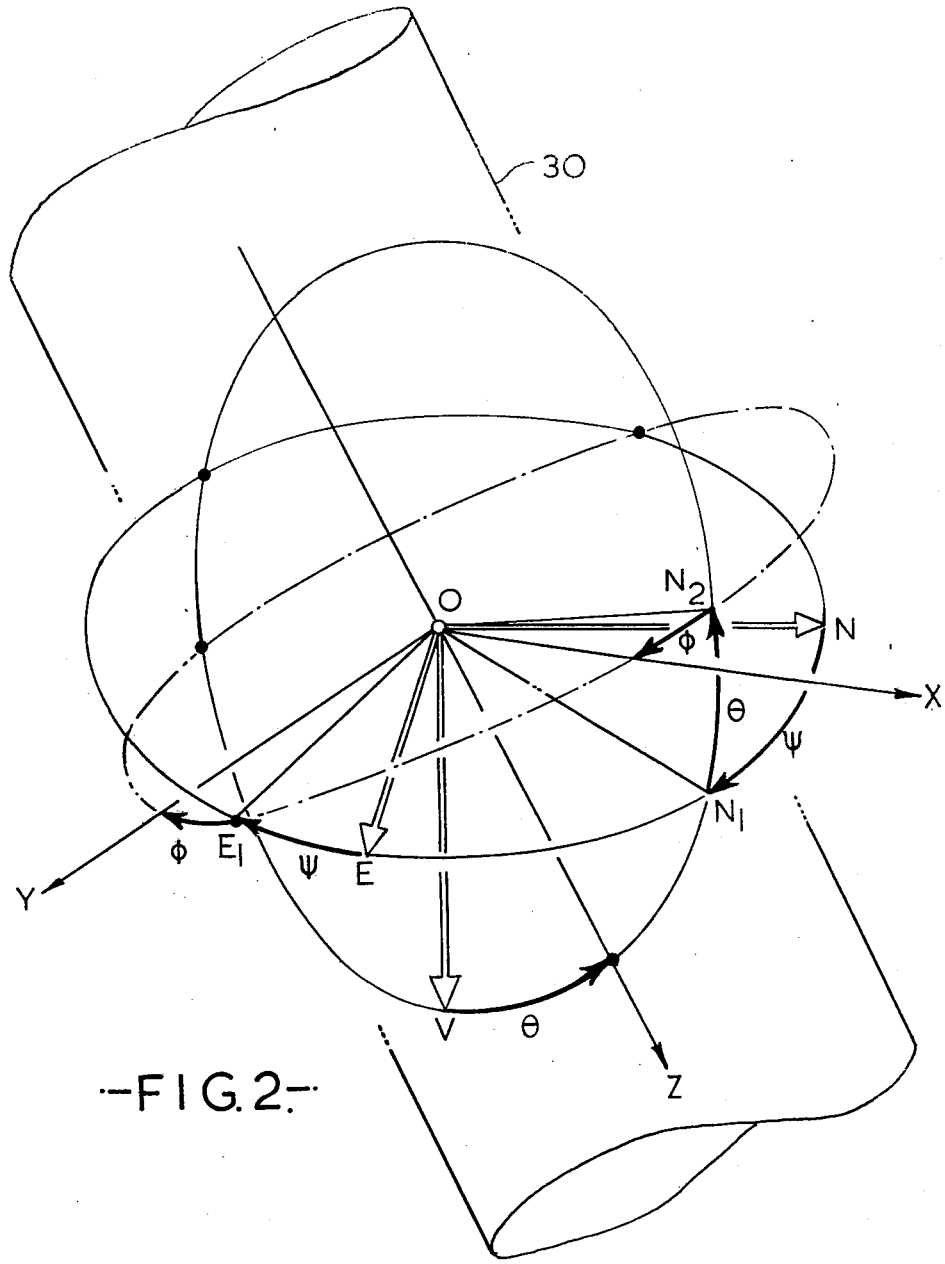
-FIG. 2-

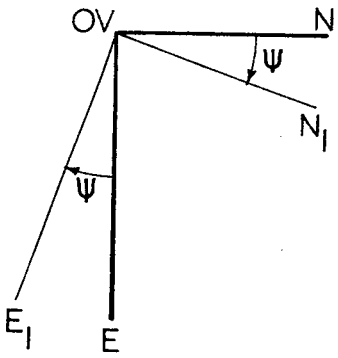
--FIG. 3--
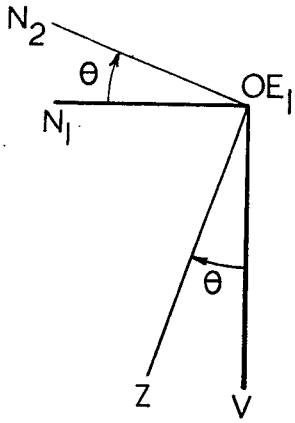
--FIG. 4--
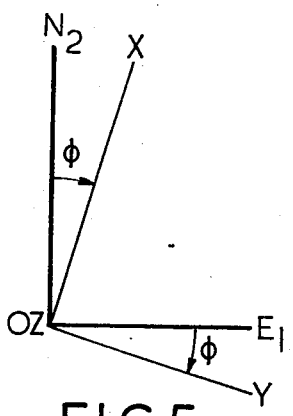
--FIG. 5--
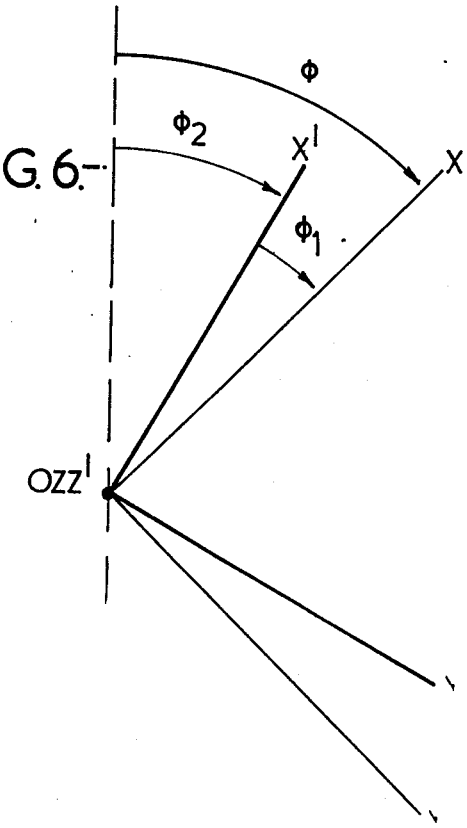
--FIG. 6--

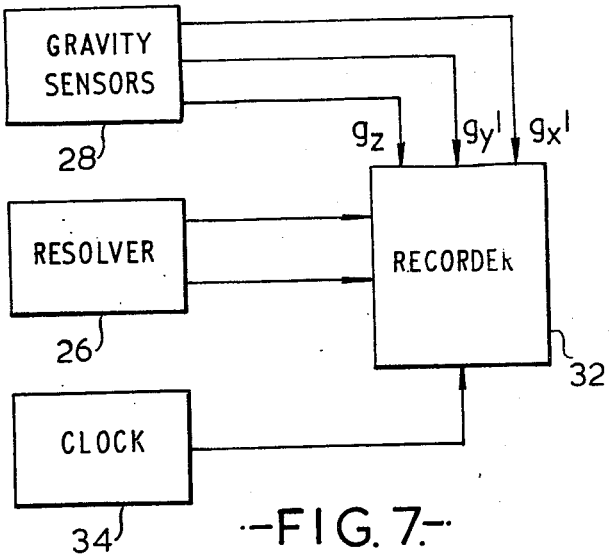
-FIG. 7.-
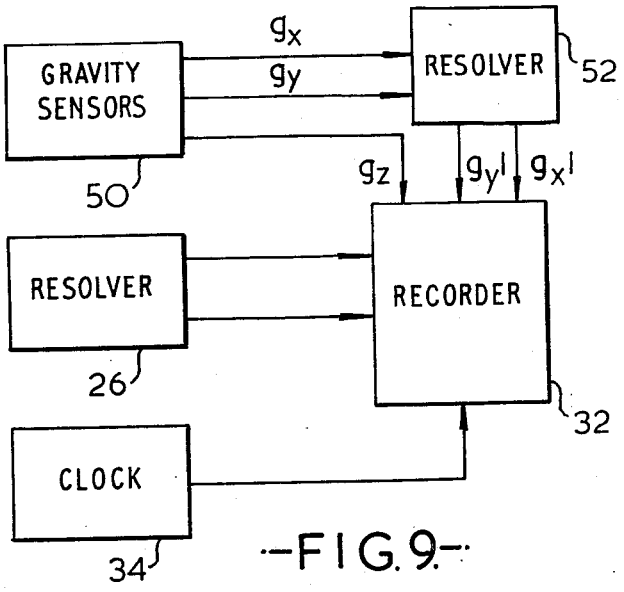
-FIG. 9.-

GYRO-STABILIZED SINGLE-AXIS PLATFORM

FIELD OF THE INVENTION

This invention relates to instruments for measuring the direction of a borehole either continuously or at a series of stations along its length.

BACKGROUND OF THE INVENTION

A spatial survey of the path of a borehole is usually derived from a series of values of an azimuth angle and an inclination angle. Measurements from which values of these two angles can be derived are made at successive stations along the path, the distances between adjacent stations being accurately known.

In a borehole where the earth's magnetic field is unchanged by the presence of the borehole itself, measurements of the components of the earth's gravitational and magnetic fields in the direction of the case-fixed axes can be used to obtain values for the azimuth angle and the inclination angle, the azimuth angle being measured with respect to an earth-fixed magnetic reference, for example magnetic north. However, in situations where the earth's magnetic field is modified by the local conditions in a borehole, for example when the borehole is cased with a steel lining, magnetic measurements can no longer be used to determine an azimuth angle relative to an earth-fixed reference. In these circumstances, it is necessary to use a gyroscopic instrument.

It has already been proposed to use a gyroscopic compass in which the spin axis is set up along an earth-fixed reference line at the mouth of the borehole and, so far as possible, held fixed in inertial space. However, this procedure has many disadvantages, largely due to the necessity of constructing such an instrument to operate within a narrow bore tube. The size of the gyro rotor, mounted with its axis across the tube, is severely limited and makes satisfactory precession drift rates very difficult to attain in practice since gimbal bearing friction must be very low to compensate for the lack of gyrospin inertia. The usual problems associated with gimbal geometry are also encountered when this type of instrument is used.

SUMMARY OF THE INVENTION

According to the invention, there is provided an instrument for measuring the direction of a borehole comprising a case having a longitudinal axis coincident, in use, with the axis of the borehole, a single-degree-of-freedom gyro comprising an outer gimbal mounted in the case with its axis coincident with the longitudinal axis thereof, an inner gimbal mounted in the outer gimbal with its axis perpendicular to the outer gimbal axis, a gyro rotor mounted in the inner gimbal, means for sensing angular movement of the inner gimbal relative to the outer gimbal and applying a torque to the outer gimbal to rotate it about its axis so that the inner gimbal precesses back to its initial position, means for measuring the angle of rotation of the case about its longitudinal axis relative to the outer gimbal and a gravity sensor unit for measuring three components of gravity in three non-coplanar directions.

The use of a single-degree-of-freedom gyro has the advantage that, since a torque is applied to the outer gimbal, friction at its bearings is not critical. In the case of the inner gimbal, where bearing friction is critical, angular movement is restricted to small values. This increases the range of techniques which can be used in bearing design. For example, the inner gimbal may be floated within the outer gimbal and ligaments used for power transmission to the driving motor for the rotor.

BRIEF DESCRIPTION OF THE DRAWINGS

An embodiment of the invention will now be described by way of example, with reference to the accompanying drawings, in which:

FIG. 1 is a schematic perspective view of an instrument in accordance with the invention, FIG. 2 is a schematic perspective view illustrating a transformation between two sets of reference axes, FIGS. 3 to 5 are diagrams illustrating, in two dimensions, the various stages of the transformation shown in FIG. 2, FIG. 6 is a diagram showing the effect of rotating the instrument shown in FIG. 1 about its axis, FIG. 7 is a block diagram of the information storage section of the instrument shown in FIG. 1, FIG. 9 is a block diagram of an alternative form of information storage section for a down-hole instrument similar to that shown in FIG. 1.

DESCRIPTION OF THE PREFERRED EMBODIMENT

Figure 8:
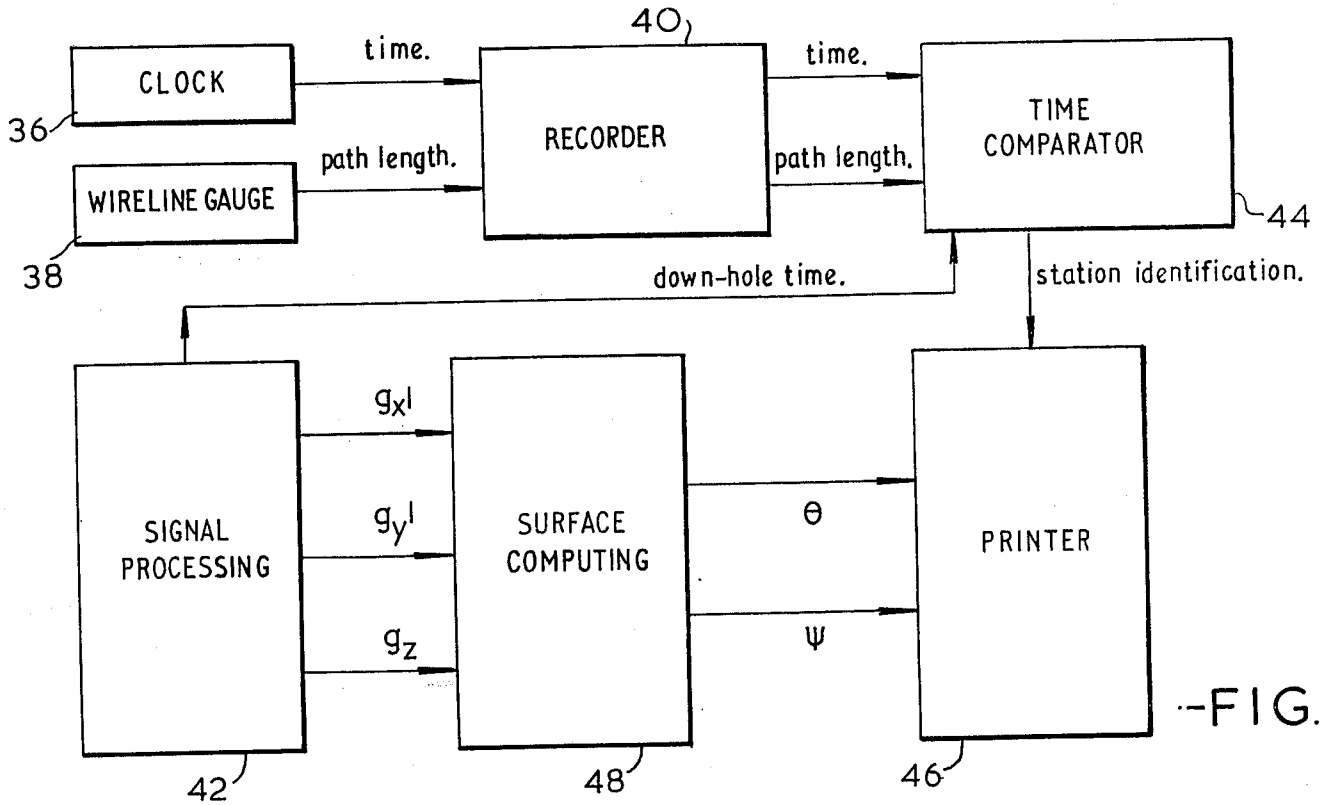
FIG. 8 is a block diagram of the surface information processing equipment for use with the instrument shown in FIGS. 1 and 7.

FIG. 1 shows an instrument in accordance with the invention mounted in a cylindrical casing 10. A gyro rotor 12 is mounted in a pair of gimbals 14 and 16, outer gimbal 16 having an axis coincident with that of the housing. The inner gimbal 14 has low friction bearings 18 allowing only a limited amount of angular movement. A position pick-off sensor 20 is arranged to provide an error signal indicating departure of the inner gimbal 14 from orthogonality with the outer gimbal 16.

The error signal from the position pick-off sensor 20 of the inner gimbal 14 is used to control a torque *r* 22 which is coupled to the shaft 24 of the outer gimbal 16 and arranged to apply a torque to rotate the outer gimbal 16 so that the inner gimbal 14 precesses back to orthogonality with the outer gimbal 16.

The outer gimbal shaft 24 also has a resolver 26 mounted thereon. The resolver 26 has a stator comprising a pair of coils with their axes orthogonal to one another and a rotor with a corresponding pair of mutually orthogonal coils. The coils of the rotor are magnetically coupled to those of the stator. A reference signal is applied to one of the coils of the rotor and the other coil is grounded. Then, if the outputs from the two coils of the stator are $a$ and $b$ respectively, then $a/b$ is equal to the tangent of the angle between the rotor and the stator, i.e., the angle $\phi_1$ between a reference direction on the housing perpendicular to its axis and a corresponding reference direction on the outer gimbal 16.

The instrument also incorporates a gravity sensor unit 28 comprising three gravity sensors mounted on the outer gimbal and arranged to sense components of gravity $g_{x'}$, $g_{y'}$ and $g_{z'}$ in three orthogonal directions OX', OY' and OZ' as described below, the direction OZ' being coincident with the bore axis. For each station, at which measurements are taken as the instrument is lowered down a borehole, the set $(g_{x'}, g_{y'}, g_{z'}, \phi_1)$ yields sufficient information to allow the set $(\Psi, \theta)$ to be derived where $\Psi$ is the azimuth angle of the bore hole and $\theta$ is the inclination angle thereof, as will be apparent from the following description. Alternatively, if the gravity sensor unit 28 was replaced by a similar unit 50 mounted on the case 10 as shown in chain-dotted lines in FIG. 1, instead of on the outer gimbal 16, the resulting set ($g_x$, $g_y$, $g_z$, $\phi_1$) also yields sufficient information.

FIG. 2 shows a bore hole 30 schematically and illustrates various reference axes relative to which the orientation of the bore hole 30 may be defined. A set of earth-fixed axes (ON, OE, OV) are illustrated with OV vertically down and ON being a horizontal reference direction. A corresponding case-fixed set of axes (OX, OY, OZ) are illustrated where OZ is the longitudinal axis of the bore hole (and therefore of the instrument) and OX and OY are in a plane perpendicular to the bore hole axis represented by a chain-dotted line. The earth-fixed set of axes rotate into the instrument-fixed set of axes via the following three clockwise rotations:

Rotation about the axis OV through the azimuth angle $\Psi$ as shown in FIG. 3, Rotation about the axis $OE_1$ through the inclination angle $\theta$ illustrated in FIG. 4, and Rotation about the axis OZ through the high-side angle $\phi$ as shown in FIG. 5.

The relationship between the high-side angle $\phi$ and the angle $\phi_1$ measured by the resolver 26 in the instrument is illustrated in FIG. 6. OX', OY' and OZ' are the outer-gimbal-fixed axes along which the three components of gravity $g_{x'}$, $g_{y'}$, and $g_{z'}$ are sensed. $\phi_2$ is the high-side angle which would be obtained if the instrument was taken to a station without rotation about the case-fixed axis Z.

If the gravity sensors are mounted on the case then the gravity vector $\bar{g} = g_x \cdot \bar{U}_x + g_y \cdot \bar{U}_y + g_z \cdot \bar{U}_z$ where $\bar{U}_x$, $\bar{U}_y$ and $\bar{U}_z$ are the unit vectors in the case-fixed axes directions OX, OY and OZ respectively. If the gravity sensors are mounted on the outer gimbal then the gravity vector $\bar{g} = g_{x'}\bar{U}_{x'} + g_{y'}\bar{U}_{y'} + g_{z'}\bar{U}_{z'}$ where $\bar{U}_{x'}$, $\bar{U}_{y'}$ and $\bar{U}_{z'}$ are the unit vectors in the outer gimbal frame directions OX', OY' and OZ' respectively. Thus, $$g_{x'} = g_x \cos\phi_1 - g_y \sin\phi_1 \quad \text{(A)}$$

$$g_{y'} = g_x \sin\phi_1 + g_y \cos\phi_1 \quad \text{(B)}$$

$$g_{z'} = g_z \quad \text{(C)}$$

If $\bar{U}_N$, $\bar{U}_E$ and $\bar{U}_v$ are unit vectors in the earth-fixed axes directions ON, OE and OV respectively, then according to the definition of the angles $\phi$, $\theta$ and $\Psi$ the vector operation equation $\bar{U}_{NEV} = \{\Psi\}\{\theta\}\{\phi\}U_{XYZ}$ represents the transformation relationship between the sets of unit vectors in the two frames where, $$\begin{bmatrix} \cos\psi & -\sin\psi & 0 \\ \sin\psi & \cos\psi & 0 \\ 0 & 0 & 1 \end{bmatrix} = \{\psi\}$$

$$\begin{bmatrix} \cos\theta & 0 & \sin\theta \\ 0 & 1 & 0 \\ -\sin\theta & 0 & \cos\theta \end{bmatrix} = \{\theta\} \text{ and}$$

$$\begin{bmatrix} \cos\phi & -\sin\phi & 0 \\ \sin\phi & \cos\phi & 0 \\ 0 & 0 & 1 \end{bmatrix} = \{\phi\}$$

The vector operation $\bar{U}_{XYZ} = \{\phi\}^T\{\theta\}^T\{\Psi\}^T\bar{U}_{NEV}$ represents the transformation relationship in the opposite direction.

Operating with $\{\phi\}^T\{\theta\}^T\{\Psi\}^T$ on the gravity vector $g \cdot U_v$ yields $$g_x = -g \cdot \sin\theta \cos\phi \quad \text{(i)}$$

$$g_y = g \cdot \sin\theta \sin\phi \quad \text{(ii)}$$

$$g_z = g \cdot \cos\theta \quad \text{(iii)}$$

Thus, $g_{x'} = -g \cdot \sin\theta \sin\phi \sin\phi_1 = -g \cdot \sin\theta \cdot \cos(\phi - \phi_1)$ and $g_{y'} = -g \cdot \sin\theta \cos\phi \cos\phi_1 - g \cdot \sin\theta \cos\phi \sin\phi_1 + g \cdot \sin\theta \sin\phi \cos\phi_1 = g \cdot \sin\theta \cdot \sin(\phi - \phi_1)$.

If the earth-fixed, case-fixed and outer-gimbal fixed axes coincide at the mouth of the borehole immediately prior to the survey run, then $\phi = \phi_1 + \phi_2$ and $$g_{x'} = -g \cdot \sin\theta \cdot \cos\phi_2 \quad \text{(iv)}$$

$$g_{y'} = g \cdot \sin\theta \cdot \sin\phi_2 \quad \text{(v)}$$

$$g_{z'} = g \cdot \cos\theta \quad \text{(vi)}$$

Thus, if sets of ($g_{x'}$,$g_{y'}$,$g_{z'}$) are recorded at each station then corresponding values of $\theta$ and $\phi_2$ for each station can be derived from $$\frac{\sin\phi_2}{\cos\phi_2} = \frac{g_{y'}}{-g_{x'}} \text{ and } \frac{\sin\theta}{\cos\theta} = \frac{(g_{x'}^2 + g_{y'}^2)^{\frac{1}{2}}}{g_{z'}} \quad \text{(D)}$$

Consider vector $\bar{V} = x \cdot \bar{U}_x y \cdot \bar{U}_y + z \cdot \bar{U}_z$ at station ($\phi_2$,$\theta$,$\Psi$) rotated through small rotations $\Delta\alpha \cdot \bar{U}_x + \Delta\beta \cdot \bar{U}_y$ to yield vector $\bar{V}_1 = x \cdot \bar{U}_{x1} + y \cdot \bar{U}_{z1} + z \cdot \bar{U}_{z1}$ where $\bar{U}_{x1}$, $\bar{U}_{y1}$ and $\bar{U}_{z1}$ are unit vectors in the case frame at station ($\phi_2 + \Delta\phi_2$, $\theta + \Delta\theta$, $\Psi + \Delta\Psi$). (The use of suffix $_2$ is permissible here since there is no rotation of the vector about OZ between the two adjacent stations). Then the components of $\bar{V}_1$ in the earth-fixed frame can be derived from the operator equation $$\begin{bmatrix} N_1 \\ E_1 \\ V_1 \end{bmatrix} = \{\psi + \Delta\psi\}\{\theta + \Delta\theta\}\{\phi_2 + \Delta\phi_2\} \begin{bmatrix} x \\ y \\ z \end{bmatrix} \quad \text{(vii)}$$

Now, $\bar{V}_1 = (x \cdot \bar{U}_x + y \cdot \bar{U}_x + z \cdot \bar{U}_z) + \Delta\alpha \cdot \bar{U}_x x(x \cdot \bar{U}_x + y \cdot \bar{U}_y + z \cdot \bar{U}_z) + \Delta\beta \cdot \bar{U}_y x(x \cdot \bar{U}_x + y \cdot \bar{U}_y + z \cdot \bar{U}_z)$ or, if $\Delta\alpha$ and $\Delta\beta$ are small $\bar{V}_1 = (x + z \cdot \Delta\beta) \cdot \bar{U}_x + (y - z \cdot \Delta\alpha) \cdot \bar{U}_y (z + y \cdot \Delta\alpha - x \cdot \Delta\beta) \cdot \bar{U}_z$ Thus, the components of $V_1$ in the earth fixed frame can also be derived from the operator equation $$\begin{bmatrix} N_1 \\ E_1 \\ V_1 \end{bmatrix} = \{\psi\}\{\theta\}\{\phi_2\} \begin{bmatrix} x + z \cdot \Delta\beta \\ y - z \cdot \Delta\alpha \\ z + y \cdot \Delta\alpha - x \cdot \Delta\beta \end{bmatrix} \quad \text{(viii)}$$

If the operators of (vii) and (viii) are applied to the vector $$\begin{bmatrix} 0 \\ 0 \\ 1 \end{bmatrix}$$

the following equations result from a suitable selection of the appropriate matrix elements:

$$\Delta\alpha(\sin\phi_2 \cdot \cos\theta \cdot \cos\Psi + \cos\phi_2 \cdot \sin\Psi) + \Delta\beta (\cos\phi_2 \cdot \cos\theta \cdot \cos\Psi - \sin\phi_2 \cdot \sin\Psi) = -\Delta\Psi \cdot \sin\theta \cdot \sin\Psi + \Delta\theta \cdot \cos\theta \cdot \cos\Psi. \quad \text{(ix)}$$

$$\Delta\alpha(-\sin\phi_2\cdot\sin\theta) + \Delta\beta(-\cos\phi_2\cdot\sin\theta) = -\Delta\theta\cdot\sin\theta \quad \text{(x)}$$

If the operators of (vii) and (viii) are applied to the vector $$\begin{bmatrix} 1 \\ 0 \\ 0 \end{bmatrix}$$

the following equation can be obtained from a suitable selection of the appropriate matrix elements:

$$-\Delta\beta\cdot\cos\theta = \Delta\phi_2\cdot\sin\phi_2\cdot\sin\theta - \Delta\theta\cdot\cos\theta_2\cdot\cos\theta \quad \text{(xi)}$$

From equation (x)

$$\Delta\theta = \Delta\beta\cdot\cos\phi_2 + \Delta\beta\cdot\sin\phi_2 \quad \text{(xii)}$$

From equations (x) and (xi)

$$\Delta\phi_2 = (\cos\theta/\sin\theta)\,(-\Delta\beta\cdot\sin\phi_2 + \Delta\alpha\cdot\cos\phi_2) \quad \text{(xiii)}$$

and from equations (ix) and (x)

$$\Delta\Psi = (1/\sin\theta)\,(\Delta\beta\cdot\sin\phi_2 - \Delta\alpha\cdot\cos\phi_2) \quad \text{(xiv)}$$

Finally, from results (xiii) and (xiv)

$$\Delta\Psi = -(1/\cos\theta)\cdot\Delta\phi_2 \quad \text{(E)}$$

Thus, if the set $(g_x, g_y, g_z, \phi_1)$ is known at each station along the path of the borehole, then the corresponding sets of $(g_{x'}, g_{y'}, g_{z'})$ can be derived from equations (A), (B) and (C). Corresponding sets of $(\theta, \phi_2)$ can then be derived using equations (D) and the increment in azimuth $\Delta\Psi$ between any two adjacent stations can be derived from the increment $\Delta\phi_2$ between those stations by the use of equation (E). Provided that the outer gimbal fixed axes and the earth fixed axes coincide at the mouth of the borehole immediately prior to the survey run, the azimuth at each station along the path measured with respect to the ON direction can be arrived at by continuous summation of the azimuth increments along the path to each station. In practice, however, the necessity to align the spin axis with ON at the mouth of the well is obviated provided that the initial angle $\Psi_O$ between OX' and ON is known. The azimuth is then derived by applying the correction $\Psi_O$ such that $\Psi = \Psi_O + \Sigma(\Delta\Psi)$ where the summation is taken along the path to the station considered.

In addition to the gyro-stabilized single-axis platform section and the gravity sensor unit as described above, the down-hole instrument contains an information storage section as shown in FIG. 7. Since the gravity sensor unit 28 is mounted on the outer gimbal with the sensing axes of the sensors along the OX', OY' and OZ directions, the outputs from these sensors are directly equal to $g_{x'}$, $g_{y'}$ and $g_{z'}$ respectively. These outputs are applied directly to a recorder 32. This obviates the need to use equations (A), (B), and (C). The outputs from the resolver 26 are also connected to the recorder 32 and used to determine the initial value of the angle $\phi_1$ between the spin axis of the gyro rotor 12 and the earth-fixed reference direction ON at the start of each run. The recorder 32 also records the output from a clock 34 to provide a record of the time at which each reading of the outputs from the gravity sensor unit 28 is made.

FIG. 8, shows the corresponding surface equipment to the down-hole information storage equipment shown in FIG. 7. The outputs from a surface clock 36 and a wire line gauge 38, which measures the length of the wire line on which the down-hole instrument is suspended, are recorded on a surface recorder 40 during each measuring run. After completion of each run, the recording made on the down-hole recorder 32 is transferred to a signal processing unit 42 where the recording is replayed simultaneously with the replaying of the recording made by the surface recorder 40. The recorded output from the down-hole clock 34, together with time and path length outputs from the recorder 40 are applied to a time comparator 44 which provides a station identification signal comprising the path length signal synchronized with the replaying of the recorded values of the output from the gravity sensor unit 28 which is applied to one input of a printer 46. The outputs $g_{x'}$, $g_{y'}$, $g_{z'}$ and $\phi_1$ are applied to a surface computing unit 48 which computes the inclination angle $\theta$ and the azimuth angle $\Psi$ and applies signals representing these angles to the printer 46 which thus provides a record of the inclination angle $\theta$ and the azimuth angle $\Psi$ at each stations at which a reading is taken together with information identifying the relevant station.

As mentioned above, the gravity sensor unit 28 mounted on the outer gimbal 16 (FIG. 1) may be replaced by three gravity sensors mounted on the instrument case 10 with the axes of the sensors thereof lying along the OX, OY, OZ, directions, so that the sensor outputs are $g_x$, $g_y$ and $g_z$. FIG. 9 shows a down-hole instrument section for use in the circumstances. The output from the resolver 26 and the clock 34 are connected to the recorder 32 as before. The $g_z$ output from a gravity sensor unit 50 mounted on the case 10 is also applied directly to the recorder 32 but the outputs $g_z$ and $g_y$ from the gravity sensor 50 are applied to respective stator coils of a second resolver 52 which is also mounted between the outer gimbal 16 and the case 10. The outputs from the rotor coils of the resolver 52 comprise the signals $g_{y'}$ and $g_{x'}$ and these signals are applied to the recorder 32. The recorded signals are thus the same as those recorded using the instrument section shown in FIG. 7.

As a modification to the arrangement shown in FIG. 9, all three outputs $g_x$, $g_y$, and $g_z$ from the gravity sensors unit 50 may be applied to the recorder 32. In this case, the signals from the resolver 26 are used to provide an indication of the angle between the outer gimbals and the case throughout each measuring run and not merely to indicate the initial angle and calculations in accordance with equations A, B, and C are performed on the surface.

If a suitable signal path is available on the one line on which the down-hole instrument is suspended the output from the down-hole instrument can be transmitted directly to the surface and no down-hole time reference is required. The surface equipment shown in FIG. 8 is then modified by omission of the surface clock 36, recorder 40 and time comparator 44, the output of the wire line gauge 38 being connected directly to the printer 46. The signal processing unit 42 is also modified to receive the signals transmitted from the down-hole instrument instead of to replay a recording.

If the instrument is used to record information during the run prior to processing at the end of the run, measured parameter storage can be used conveniently in the form of integrated-circuit memory storage packs. The instrument used in this mode would be battery powered from a battery pack built within the case.

The invention is also applicable to a directional drilling process in which it is required to build inclination angle in a known azimuth direction from a shallow near-vertical cased hole. In these circumstances, the near-verticality prohibits the use of a conventional high-side steering tool and the casing prohibits the use of a conventional magnetic steering tool. If a single-axis stabilized platform instrument in accordance with the invention is used to establish the direction of the spin axis with respect to a horizontal reference ON at the mouth of the hole, then this axis will remain substantially referenced with respect to ON as the instrument is lowered through the near-vertical section of the hole. Thus, if the instrument is lowered to locate with the bent-sub/mud-motor arrangement as with the conventional steering tool, then the rotation of the case about the spin axis $\phi_1$ can be used to establish the direction of the bent-sub/mud-motor with respect to the earth-fixed direction ON.

We claim:

1. An instrument for measuring the direction of a borehole comprising a case having a longitudinal axis coincident, in use, with the axis of the borehole, a single-degree-of-freedom gyro comprising an outer gimbal mounted in the case with its axis coincident with the longitudinal axis thereof, an inner gimbal mounted in the outer gimbal with its axis coincident with the outer gimbal axis, a gyro rotor mounted in the inner gimbal, means for sensing angular movement of the inner gimbal relative to the outer gimbal and applying a torque to the outer gimbal to rotate it about its axis so that the inner gimbal precesses back to its initial position, means for measuring the angle of rotation of the case about its longitudinal axis relative to the outer gimbal and a gravity sensor unit for measuring three components of gravity in three non-coplanar directions.

2. An instrument according to claim 1, in which the gravity sensors are mounted on the outer gimbal.

3. An instrument according to claim 1, in which the gravity sensors are mounted on the case of the instrument.

4. An instrument according to claim 3, including a resolver mounted on the instrument case and having its rotor connected to the outer gimbal, two of the gravity sensors being arranged to sense components of gravity in directions perpendicular to the longitudinal axis of the instrument and having their outputs connected to the inputs of the resolver.

5. A method of surveying a borehole comprising:

moving a survey instrument along the borehole, said survey instrument comprising a case having a longitudinal axis coincident, in use, with the axis of the borehole, a single-degree-of-freedom gyro comprising an outer gimbal mounted in the case with its axis coincident with the longitudinal axis thereof, an inner gimbal mounted in the outer gimbal with its axis perpendicular to the outer gimbal axis, a gyro rotor mounted in the inner gimbal;

continually sensing angular movement of the inner gimbal relative to the outer gimbal as the instrument moves along the borehole and applying a torque to the outer gimbal to rotate it about its axis so that the inner gimbal precesses back to its initial position;

determining at each of a series of survey stations spaced along the borehole a set of three components of gravity in three non-coplanar directions relative to the outer gimbal;

calculating, from the sensed components of gravity at each of said survey stations, the inclination of the borehole and the non-rotative high-side angle of the instrument relative to a reference direction which does not rotate about the longitudinal axis of the instrument as it travels along the borehole at each station; and calculating, from said inclination and non-rotative high-side angle, the azimuth of the borehole at each station.

6. A method of surveying a borehole according to claim 5, wherein the set of three components of gravity is measured, at each station, by three sensors mounted on the outer gimbal.

7. A method of surveying a borehole according to claim 5, wherein a second set of three components of gravity is measured, at each station, by three sensors mounted on the instrument case, the method further comprising measuring, at each station, the angle of rotation of the instrument case relative to the outer gimbal and calculating said first mentioned set of components of gravity from said second set and said angle of rotation.

8. A method of surveying a borehole according to claim 7, wherein one component of each of said sets of components of gravity is parallel to the outer gimbal axis and the other two components of the first-mentioned set are calculated by setting the stator and rotor of a resolver at a relative angle equal to said angle of rotation and applying the other two components of the second set to the input of the resolver.

* * * * *

UNITED STATES PATENT AND TRADEMARK OFFICE

CERTIFICATE OF CORRECTION

PATENT NO. : 4,071,959

DATED : February 7, 1978

INVENTOR(S) : Michael King RUSSELL et al.

It is certified that error appears in the above–identified patent and that said Letters Patent are hereby corrected as shown below:

Column 7, line 29, change "coincident with" to --perpendicular to--.

Signed and Sealed this

*Thirteenth* Day of *October 1981*

[SEAL]

*Attest:*

GERALD J. MOSSINGHOFF

*Attesting Officer*

*Commissioner of Patents and Trademarks*